United States Patent [19]

Carter

[11] Patent Number: 4,766,455

[45] Date of Patent: Aug. 23, 1988

[54] PROCESS UNIT FOR AN IMAGING APPARATUS

[75] Inventor: Robert A. Carter, Stevenage, Great Britain

[73] Assignee: Xerox Corporation, Stamford, Conn.

[21] Appl. No.: 38,093

[22] Filed: Apr. 14, 1987

[30] Foreign Application Priority Data

Apr. 15, 1986 [GB] United Kingdom ..... 8609160

[51] Int. Cl.[4] ..... G03G 15/00

[52] U.S. Cl. ..... 355/3 BE; 355/3 DR; 355/16

[58] Field of Search ..... 355/3 R, 3 DR, 3 BE, 355/16; 354/212, 213

[56] References Cited

U.S. PATENT DOCUMENTS 3,985,436 10/1976 Tanaka et al. ..... 355/8
4,497,556 2/1985 Edwards ..... 354/212
4,551,000 11/1985 Kanemitsu et al. ..... 355/3 DR X
4,561,763 12/1985 Basch ..... 355/3 DR
4,634,264 1/1987 Takahashi ..... 355/3 BE X
4,655,578 4/1987 Kurtz et al. ..... 355/3 BE X

*Primary Examiner*—A. C. Prescott
*Attorney, Agent, or Firm*—Peter H. Kondo

[57] ABSTRACT

A cassette for an electrophotographic imaging machine contains a photoreceptor, such as a drum or endless belt photoreceptor and optionally one or more process means, such as a charge corotron, a development device, a transfer corotron and a cleaning device. The photoreceptor belt is loosely held in an open loop, for example by means of belt retaining strips, within a cassette when the cassette is out of the main machine. When the cassette is inserted into a suitably shaped aperture in the main machine, the photoreceptor engages over a plurality of support rollers. At least one of the rollers is movable so as to space it from another roller, thereby tensioning the photoreceptor belt and accurately locating the belt within the main machine. One of the support rollers may also be a drive roller for the belt.

19 Claims, 4 Drawing Sheets

PROCESS UNIT FOR AN IMAGING APPARATUS

BACKGROUND OF THE INVENTION

This invention relates generally to an imaging apparatus, and is particularly, although not exclusively, concerned with a xerographic copying apparatus. The invention is more especially concerned with an imaging apparatus having a process unit adapted to be removably mounted in a main assembly of the imaging apparatus, the process unit including an imaging member and optionally one or more process means.

Such a process unit might comprises a xerographic process cassette of the kind which includes only the photoreceptor, or the photoreceptor and at least one of the process means such as a charge corotron, a development device, a transfer corotron, and a cleaning device. An example of such a xerographic process cassette is described in U.S. Pat. No. 3,985,436. The use of a cassette of this kind enables the easy replacement of those parts of a xerographic machine which are most likely to deteriorate with use, especially the photoreceptor, but also the development and cleaning systems as well as the corotron wires. A further advantage of containing the major xerographic process elements within a cassette is that interchangeable cassettes may be used in a given copying machine, to provide different development characteristics, or different coloured development.

PRIOR ART STATEMENT

U.S. Pat. No. 3,985,436 issued to Susmu Tanaka et al on Oct. 12, 1976—A cassette for an electrophotographic copying apparatus is disclosed comprising a photoreceptor, a developing device and a cleaning device in a casing. The cassette is releasably insertable into the housing of the electrophotographic copying apparatus.

U.S. Pat. No. 4,497,556 issued to Evan A. Edwards on Feb. 5, 1985—A film system for a photographic still camera is described. The film system comprises paper backed film strip wound in a supply coil with the leading end of the paper backing attached to a take-up spindle in a take-up container. The camera contains components that cooperate with the film system to advance the film strip.

It is advantageous to make the insertion and withdrawal opertions as simple and reliable as possible, without the need for elaborate mechanisms to ensure that the photoreceptor arrives at exactly the correct position for an in-focus image to be formed on it by the optical system of the machine. This becomes especially important when considering interchangeable cassettes because of the possibility of frequent changes of cassette. Furthermore, it would be advantageous if the cassette contained the minimum of mechanical components associated with the xerographic processor and of the kind which do not rapidly deteriorate, so as to make the cassette as inexpensive as possible. One service option with a very low cost cassette is to make it a truly "throw-away" item once one or more of its components has deteriorated to such an extent as to be no longer useful.

SUMMARY OF THE INVENTION

The present invention is intended to provide a process unit for an imaging apparatus which has these advantageous features. The process unit of the invention is characterised by the image bearing member being loosely retained in the process unit when the process unit is removed from the main assembly, and being adapted to be supported in an oeprative position by support means forming part of the main assembly when the process unit is inserted into the main assembly.

In a preferred form of the invention, the imaging member comprises an endless photosensitive belt. When the process unit is inserted into the main assembly, the belt is engaged by spaced holding members forming part of the main assembly. The holding members are then operated to move them to a position which tensions the belt. This arrangement makes it possible to provide a cassette in which no driving mechanisms are needed, in which insertion and withdrawal of the cassette are simple operations, and in which accurate positioning of the photosensitive member relative to the optics of the machine is automatically achieved.

The photoreceptor supporting and driving arrangements are mounted in the main machine, thus simplifying and reducing the number of components in the cassette, and also avoiding the problem of accurate positioning of the photoreceptor within the machine. The invention can be applied to drum photoreceptors as well as to endless belts.

BRIEF DESCRIPTION OF THE DRAWING

Various embodiments of the invention will now be described, by way of example, with reference to the accompanying drawings, in which.

Figure 1:
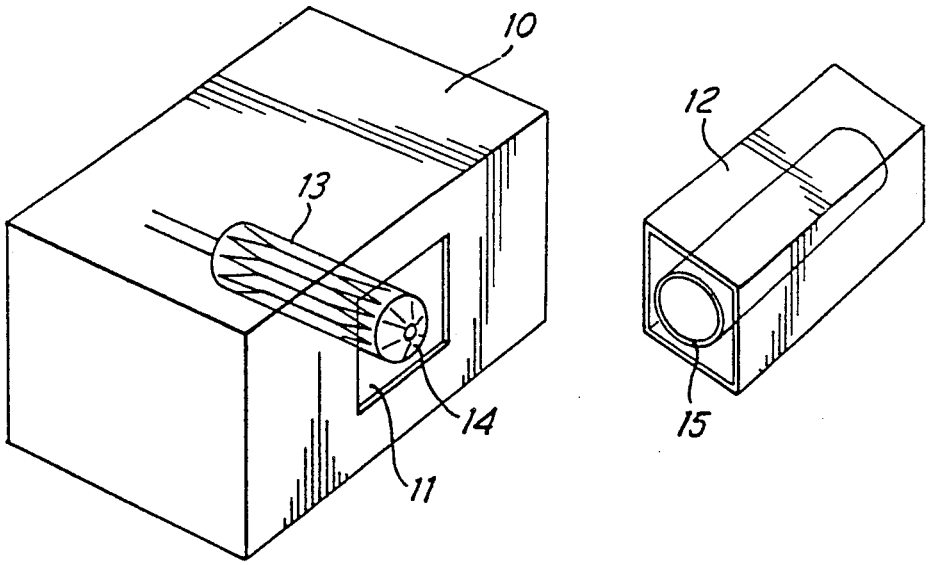
FIGS. 1 to 3 are diagrammatic representations showing the basic principle of operation of three embodiments of the invention.

Referring to the drawings, the simplest example of the invention is when applied to a hard cylindrical (drum) photoreceptor as shown in FIG. 1. A xerographic machine 10 has an aperture 11 to accept the cassette 12, and within the aperture 11 is located a drive and location shaft 13 for the photoreceptor which is cantilevered from the rear of the machine. The shaft 13 has a tapered end 14 to aid engagement of the photoreceptor over the shaft, and could be of the expanding mandrel type. The cassette 12 has a loosely held, hollow, cylindrical photoreceptor 15 located within an open ended cavity to enable engagement of the drive and location shaft 13 into the photoreceptor 15. When the cassette is inserted into the machine, the photoreceptor 15 is located by the drive and location shaft 13, thus minimising location errors between the photoreceptor and the imaging unit of the machine.

Figure 2:
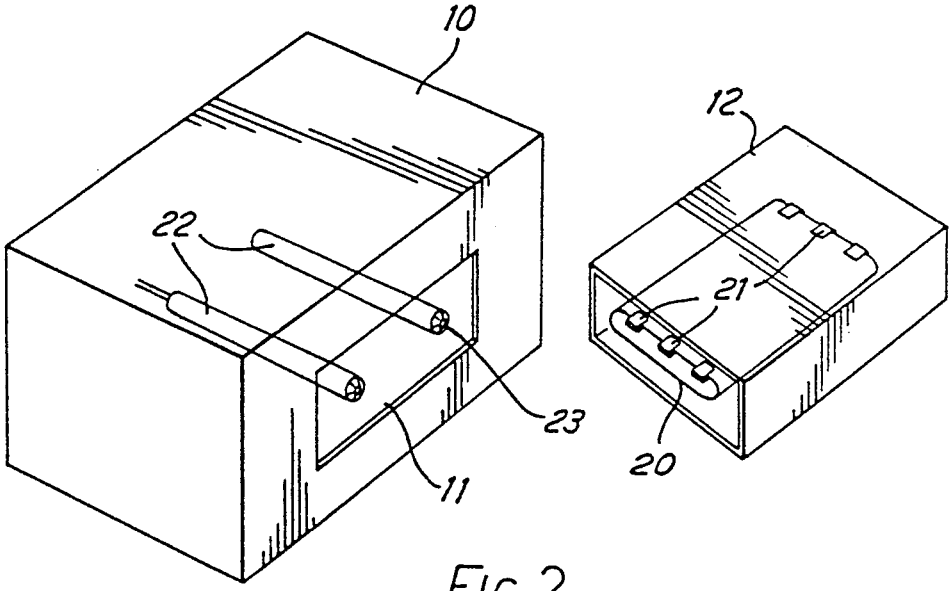
Figure 3:
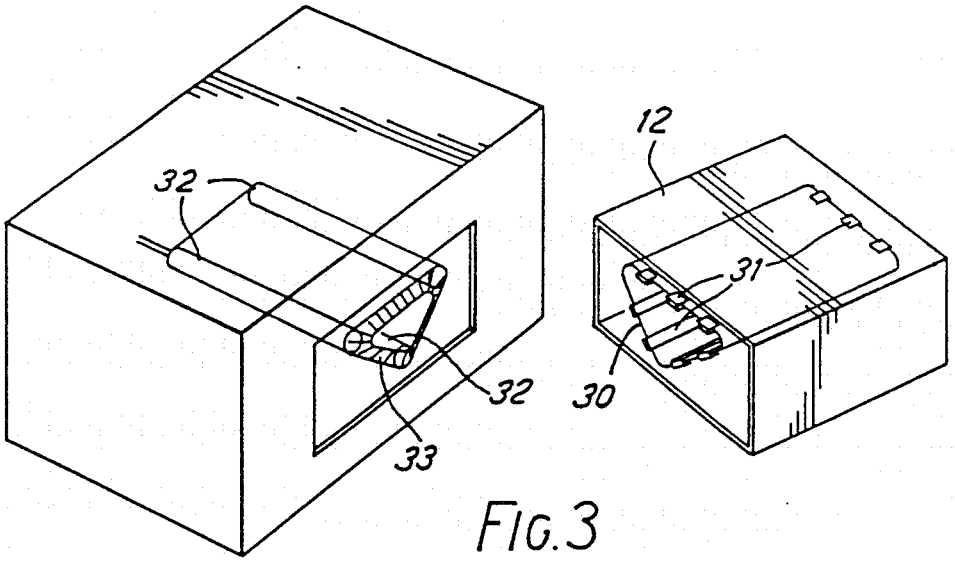

Referring now to FIGS. 2 and 3, there are shown two embodiments of the invention using flexible, endless photoreceptor belts. The FIG. 2 embodiment uses a two-roller support arrangement, whereas that shown in FIG. 3 has three rollers. In FIG. 2, the belt 20 is loosely held in the cassette 12 by means of belt retaining strips 21 to be described below. As in the FIG. 1 embodiment, the cassette 12 is inserted into an aperture 11 in the machine 10, the belt 20 being so positioned as to slide over two support rollers 22. Either or both of the rollers may be movable such as to space them further apart, operable after insertion of the cassette, to locate and tension the belt 20. Once it is positioned and tensioned over the rollers 22, the belt 20 runs out of contact with the belt retaining strips 21, and may be driven around the rollers, for example by one or both of the rollers, or by other drive means cooperating with the belt. One of the rollers may be replaced by a skid member (e.g. a non-rotating cylinder), or in the case where some other drive means is used, both the rollers may be replaced by skid members. The space between the rollers may be vacant, or substantially filled, or, preferably, may contain processor elements. The rollers 22 may have tapered end portions 23 to assist in the initial location of the rollers into the loop formed by the belt.

FIG. 3 shows a three-roller embodiment, which operates in substantially the same way as the FIG. 2 embodiment. The belt 30 in the cassette 12 is loosely held in a generally triangular configuration by belt retaining strips 31, and the rollers 32 in the machine are spaced apart in a triangular configuration for receiving the belt 30. The rollers 32 may be provided with tapering ends, or a tapering triangular member 33 may be support by the rollers 32 to assist in locating the belt 30 over the rollers.

Figure 4:
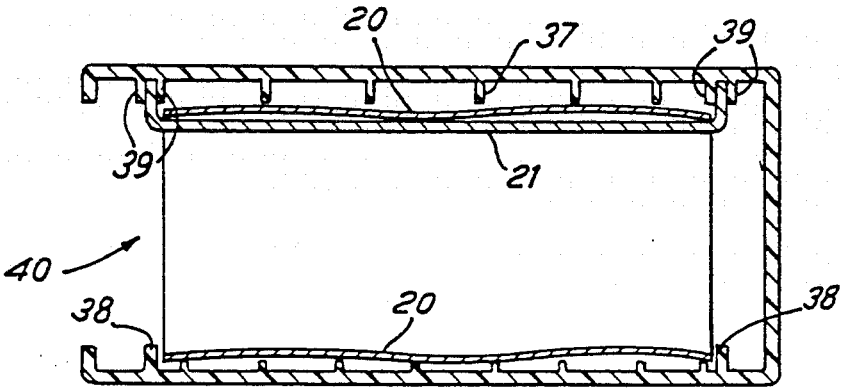
FIGS. 4 and 5 are cross sectional view of a cassette showing two alternative ways in which a photoreceptor belt may be retained in a cassette.

In the FIGS. 2 and 3 embodiments, the cassette includes a housing member which cooperates with the photoreceptor belt to constrain the external contour of the belt to the desired configuration. A suitable ribbed housing 36 for this purpose is shown in FIG. 4, with the photoreceptor belt 20 loosely retained between the ribs 37 and a set of belt retaining strips 21. Lateral movement of the belt is presented by the upturned ends of the belt retaining strips 21 on the upper run of the belt, and by larger ribs 38, at each side of the base of the housing. The upturned ends of the belt retaining strips 21 are secured by sets of clamping ribs 39 to the roof of the housing. In this way, the upper belt run of the belt 20 is loosely defined, while the remainder of the belt hangs freely below it in a loop. Belt retaining strips, not shown, may also be provided for the lower run of the belt. When a cassette of this construction is inserted into the main assembly of the copying machine, its open end 40 allows the support rollers to locate inside the loop of the photoreceptor belt 20 in the same way as shown in FIG. 2. Once the belt has been tensioned (by moving the support rollers apart) its upper run lies between the ribs 37 and the belt retaining strips 21. In the case where the space between the tensioning rollers is filled, with a casing extending between the rollers, the casing may be formed with recesses or grooves to accommodate the belt retaining strips when the cassette is in the machine.

Figure 5:
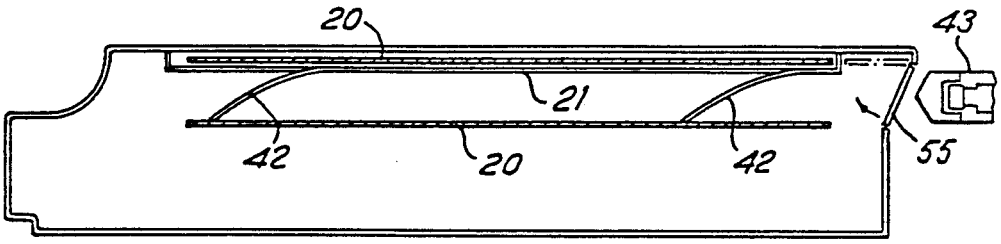

Referring now to FIG. 5, there is shown an alternative arrangement for supporting the photoreceptor belt 20 within a cassette. The upper run of the belt is loosely retained between belt retaining strips 21 and the roof of the cassette, with the lower run of the belt hanging down in a loop. The lower run of the belt occupies a position near the mid-plane of the cassette, and cannot therefore be supported or guided by the floor of the cassette. In order to ensure that the belt loop is always open and ready to receive the tensioning rollers, a set of flexures 42 are provided, secured at one end to the belt retaining strips 21, and contacting the inside surface of the belt 20 with their free ends so as to resiliently urge the belt into the desired open loop configuration. In this arrangement, the tensioning rollers are mounted at each end of a drive module 43 which substantially fills the space between the rollers. On insertion of the cassette into the machine, the drive module 43 slides into the space inside the photoreceptor belt loop, engaging the flexures 42 as it does so, and pushing them upwards. The drive module 43 is grooved to accommodate the flexures 42. Once the cassette is fully engaged, the tensioning rollers in the drive module 43 are urged apart to tension the belt. This tensioning may be done manually, e.g. by operation of a suitable lever, or automatically, upon location of the cassette into its fully inserted position. On removal of the cassette, (after first releasing the tension in the belt) the flexures spring back and hold the photoreceptor belt loop open again.

Figure 6:
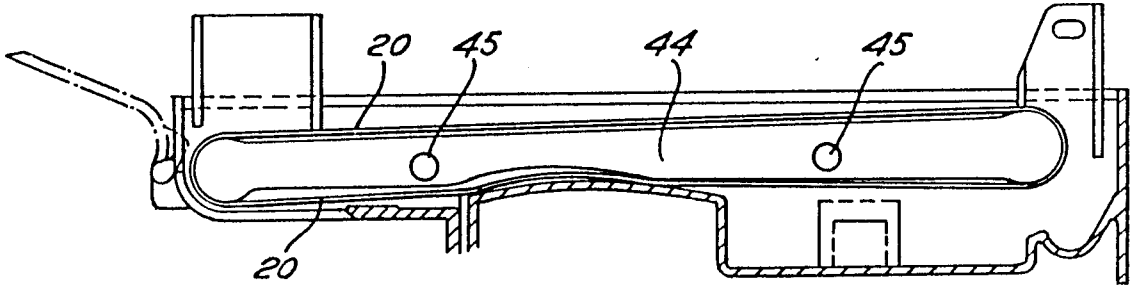
FIG. 6 is a cross sectional side view of a further embodiment of a cassette, installed in a machine.
Figure 7:
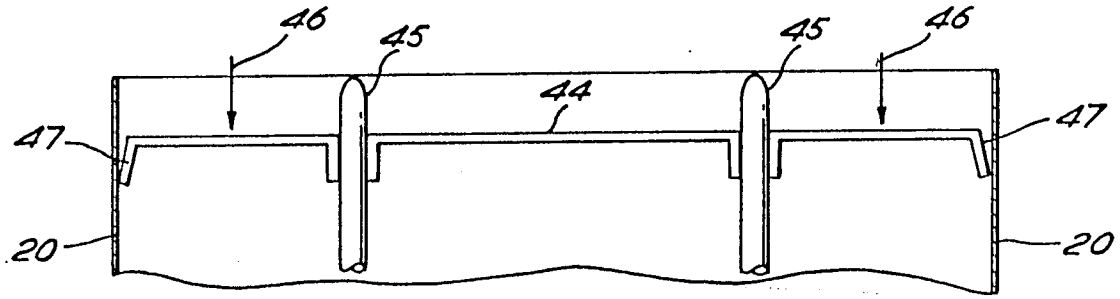
FIG. 7 is a cross sectional, partial plan view of the cassette of FIG. 6.

Another way of holding the photoreceptor belt open when the cassette is out of the machine is shown in FIGS. 6 and 7. In this arrangement, the inside of the photoreceptor belt 20 is constrained into the shape of the belt drive assembly by a sliding former 44 that can slide inside the photoreceptor belt in the cassette on rods 45, or on a similar guide rail arrangement. When the cassette is outside the machine the sliding former 44 is at the rear of the unit, holding open the photoreceptor belt loop. On insertion of the cassette into the machine, the former 44 is pushed through the photoreceptor belt loop by the belt drive assembly, as indicated by arrows 46, until it passes out of the front end of the photoreceptor belt loop, whereafter the belt can be tensioned. On removal of the cassette, after releasing the belt tension, a latching arrangement pulls the former 44 back inside the photoreceptor loop, aided by the tapered shape 47 of the former, and the former is returned to its original position at the rear of the cassette when the latching arrangment releases to free the cassette from the machine.

The cassette of the present invention is particularly advantageous when the photoreceptor belt is transparent or translucent. In these circumstances, the photosensitive surface of the photoreceptor belt may be exposed to light, either for imaging in (e.g. by means of a LED writing array) or discharge (e.g. for intercopy and edge fadeout), by exposure means located inside the belt drive module, thus further simplifying the cassette.

As well as containing the photoreceptor, the cassette may also contain one or more other xerographic process assemblies, such as charging, erasing, development, transfer, or cleaning assemblies.

In the case of the cassette containing a flexible belt photoreceptor, various methods may be employed for tracking or steering the belt, some examples of which will be described with reference to FIGS. 8 to 10.

Figure 8:
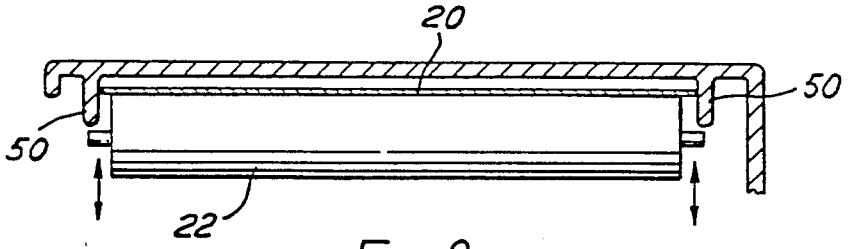
FIG. 8, 9 and 10 are diagrammatic sectional views showing guiding systems for the photoreceptor belt.

Referring to FIG. 8, an edge force on the edgers of the photoreceptor belt may be used to guide the belt, the edge force being provided by edge guides 50. The edge guides 50 may be provided as ribs on the inside of the cassette housing at a position adjacent one of the tension rolls. The tension roll, which is mounted in the belt drive module of the main assembly of the machine, is cammed into engagement between the edge guides. In this arrangement, the tension roll is preferably a slotted roll, i.e. a roll in the form of a succession of spaced discs of a resilient material, that has low lateral shear characteristics, or can alternatively be a low shear modulus material (e.g. a foamed resilient plastics material). Alternatively, a nonrotational skid may be substituted to the tension roll, and such a skid can act as a camming member since it offers no frictional resistance to sideways movement of the photoreceptor belt.

Figure 9:
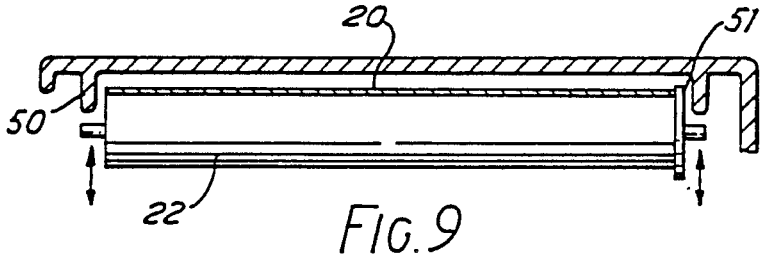

An alternative guidance arrangement is shown in FIG. 9. In this arrangement, the belt drive module is arranged so as to always drive the photoreceptor belt into the cassette (i.e. away from its open end) and for this purpose the camming roller or skid has a flange 51 which limits the outward motion of the photoreceptor belt. This arrangement is in other respects similar to the FIG. 8 embodiment.

Figure 10:
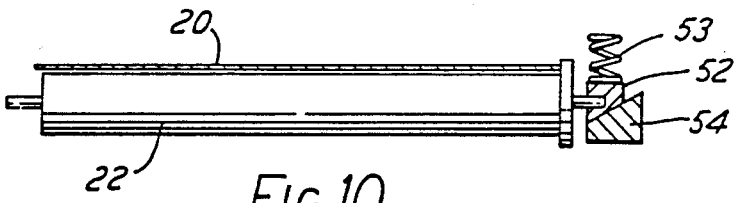

FIG. 10 shows a further refinement to the arrangement of FIG. 9. In this arrangement, the tension roller is allowed to travel laterally under the influence of the edge force, and the lateral motion is used to steer the roller, thus reducing the edge force to a low level. The roll bearing 52 is urged by a spring 53 into engagement with an inclined support 54.

In a cassette which uses a delicate photoreceptor belt, or one for which considerable use is anticipated, it is advantageous to avoid using edge forces altogether for controlling the belt steering system. This can be achieved by optically sensing the photoreceptor belt position, and steering a roll or skid with a servomotor or solenoid. Here again, the additional complexity required is in the belt driving module of the machine, and the cassette is of simple construction.

In order to protect the photoreceptor belt from damage in the environment, for example by over exposure to light, dust, or handling, it is advantageous to have a cover at the open end of the cassette. This can be a simple spring-loaded flap 55 (FIG. 5) that is pushed open by the belt drive module 43 of the machine when the cassette is inserted.

I claim:

1. Process unit adapted to be removably mounted in a main assembly of an imaging apparatus, said process unit comprising a housing member and an endless imaging member having open opposite ends loosely retained in said housing member prior to mounting said process unit in said main assembly, said imaging member being adapted to be supported in an operative position by support means forming part of said main assembly when said process unit is inserted into said main assembly and said housing member being adapted to receive said support means through an end of said housing member into one of said open opposite ends of said imaging member when said process unit is inserted into said main assembly.

2. The process unit of claim 1 wherein said imaging member is a drum photoreceptor comprising a hollow cylindrical shell having a photosensitive surface.

3. The process of claim 1 wherein said imaging member is a belt photoreceptor comprising an endless flexible belt having a photosensitive surface.

4. The process unit of claim 3 including means to retain said belt photoreceptor in said process unit in an open loop configuration, when said process unit is removed from said main assembly.

5. The process unit of claim 4 wherein said means to retain said belt comprises a plurality of guiding surfaces within a cassette to limit outward movement of said belt from said cassette, and a plurality of retaining members inside said belt to limit inward movement of said belt from sid cassette said cassette having an opening in one side to receive said support means for insertion into one of said open oposite ends of said imaging member when said process unit is inserted into said main assembly.

6. The process unit of claim 4 wherein said means to retain said belt comprises a guiding surface within said cassette to limit outward movement of a first run of said belt, a plurality of retaining means inside said belt to limit inward movement of said first run of said belt, and resilient means urging a second run of said belt away from said first run so as to maintain said open loop configuration.

7. Imaging apparatus comprising a main assembly, at least one cantilevered support means forming part of said main assembly, and a process unit adapted to be removably mounted in said main assembly, said process unit comprising a housing member and an imaging member having open opposite ends adapted to be loosely retained in said housing member prior to mounting said process unit in said main assembly, said imaging member being supported in an operative position by said cantilevered support means, and said cantilevered support means extending through an end of said housing member into one of said open opposite ends of said imaging member to support said imaging member in said operative position.

8. An imaging apparatus according to claim 7 wherein said imaging member is a drum photoreceptor comprising a hollow cylindrical shell having a photosensitive surface.

9. An imaging apparatus according to claim 8 wherein said cantilevered support means comprises a drive shaft for said drum photoreceptor, said drive shaft comprising means for releasably securing said hollow cylindrical shell.

10. An imaging apparatus according to claim 7 wherein said imaging member is a belt photoreceptor comprising an endless flexible belt having a photosensitive surface.

11. An imaging apparatus according to claim 10 wherein a plurality of belt holding members are mounted within said main assembly and at least one of said belt holding members is movable to tension said belt so as to permit said belt to be driven around said belt holding members.

12. An imaging apparatus according to claim 11 wherein one of the belt holding members is adapted to drive said belt around said belt holding members.

13. An imaging apparatus according to claim 10 wherein said process unit comprises means to retain said belt photoreceptor in said process unit in an open loop configuration, when said process unit is removed from said main assembly.

14. An imaging apparatus according to claim 13 wherein said means to retain said belt photoreceptor comprises a plurality of guiding surfaces within a cassette to limit outward movement of said belt from said cassette, and a plurality of retaining members inside said belt to limit inward movement of said belt from said cassette.

15. An imaging apparatus according to claim 14 wherein said means to retain said belt photoreceptor comprises a guiding surface within said cassette to limit outward movement of a first run of said belt, a plurality of retaining means inside said belt to limit inward movement of said first run of said belt, and resilient means urging a second run of said belt away from said first run so as to maintain said open loop configuration.

16. An imaging apparatus according to claim 11 wherein said belt holding members comprise two rollers, at least one of which is movable away from the other to extension said belt, and at least one of which is a drive roller for said belt.

17. An imaging apparatus according to claim 7 wherein said housing comprises a open flap on said side of said housing member through which said cantilevered support means extends.

18. A process comprising providing an imaging apparatus comprising a main assembly, at least one cantilevered support means forming part of said main assembly, and a first process unit adapted to be removably mounted in said main assembly, said process unit comprising a housing member and a flexible belt imaging member having open opposite ends adapted to be loosely retained in said housing member prior to mounting said process unit in said main assembly, said imaging member being supported in an operative position by said cantilevered support means, and said cantilevered support means extending through an end of said housing member into one said open opposite ends of said imaging member to support said imaging member in said operative position, sliding said first process unit along said cantilevered support means in a direction away from said main assembly to remove said first process unit from said main assembly, providing a fresh second process unit substantially identical in structure to said first process unit, inserting said cantilevered support means through an end of a housing member and into one of the open opposite ends of an imaging member of said second process unit and sliding said second process unit in a direction toward said main assembly to install said said process unit in said main assembly.

19. A process according to claim 18 including holding open said belt with a sliding forming means while inserting said cantilevered support means through said side of said housing member and into one of the open opposite ends of said imaging member of said second process unit, said sliding forming means being pushed through said belt by said cantilevered support means after said cantilevered support means is inserted through said side of said housing member.

* * * * *